United States Patent [19]

Andrieux

[11] 4,433,546

[45] Feb. 28, 1984

[54] HEATER UNIT FOR HEATING WATER TO BE SUPPLIED TO A BOILER AND A WATER HEATER

[75] Inventor: Bernard Andrieux, Boulogne, France

[73] Assignee: Societe Anonyme dite: Delas-Weir, Levallois-Perret, France

[21] Appl. No.: 346,332

[22] Filed: Feb. 5, 1982

[30] Foreign Application Priority Data

Feb. 6, 1981 [FR] France ..... 81 02382

[51] Int. Cl.[3] ..... F01K 9/00

[52] U.S. Cl. ..... 60/691; 60/692

[58] Field of Search ..... 60/690, 691, 692

[56] References Cited

U.S. PATENT DOCUMENTS 3,406,749 0/0000 Stoker ..... 165/110
3,805,518 4/1974 Kasschau et al. ..... 60/692

FOREIGN PATENT DOCUMENTS 2358349 of 0000 Fed. Rep. of Germany .
1813939 of 0000 Fed. Rep. of Germany .
549433 of 0000 Fed. Rep. of Germany .
324567 of 0000 Fed. Rep. of Germany .
465428 of 0000 France .

*Primary Examiner*—Allen M. Ostrager
*Attorney, Agent, or Firm*—Sughrue, Mion, Zinn, Macpeak and Seas

[57] ABSTRACT

A heater unit for heating water which is supplied to a steam-generating boiler of an electric energy production installation which includes an alternator driven by a turbine having at least one low-pressure body (9) connected by a housing (15), to a steam condenser situated under said low-pressure body, said heater unit comprising a nest of tubes located inside said housing and being supplied with water coming from an extraction circuit for the condenser (14) and the outer surface of the tubes being supplied with steam drawn off from the low-pressure body, the nest of tubes being substantially horizontal and perpendicular to the axis (10) of the turbine, the cross-section of the nest (1) of tubes of said heater unit being narrow and elongate and the length of said cross-section being disposed substantially vertically, the nest of tubes being enclosed in a casing (16) which both channels the steam around the nest of tubes and receives the steam bleed-off pipes (15), wherein the cross-section (7) of said casing has, in the region of the bleed-off steam supply pipes, one of its sides which, going up from the bottom, slopes progressively away going from the corresponding one of the two substantially vertical sides of said narrow elongate cross-section of said nest (1) of tubes and, beyond said region, a cross-section which, while leaving a space for steam to pass, follows the profile of the contour of the cross-section of the nest of tubes, steam being supplied above said casing.

6 Claims, 4 Drawing Figures

HEATER UNIT FOR HEATING WATER TO BE SUPPLIED TO A BOILER AND A WATER HEATER

The present invention relates to a heater unit for heating water to be supplied to a steam-generating boiler in a power station or generator unit.

BACKGROUND OF THE INVENTION

It is known that electric power stations having steam generators include steam condensers which receive and condense the exhaust steam from a low-pressure turbine. Such power stations also include heaters placed in the boiler water supply circuit, said heaters being supplied with steam bled off from the turbine at different pressure levels.

To facilitate machine room installation, the first low-pressure heaters (which are cylindrical) are in most cases disposed inside the housing of the condenser which connects the turbine exhaust to the body of the condenser which contains the nest of condensation pipes.

The heaters are installed horizontally inside the housing of the condenser and perpendicular to the axis of the turbine and are supplied with steam bled off from pipes which connect the turbine directly to said heaters and which are also confined within the housing.

However, in these known dispositions, the shape of the heaters (which are generally cylindrical) and the disposition of the bleed pipes which supply them make the assembly relatively bulky and do not allow exhaust steam from the turbine to pass freely towards the nest of pipes of the condenser, in particular because of the bleed pipes which constitute obstacles on the path of said steam.

Preferred embodiments of the present invention mitigate these drawbacks.

SUMMARY OF THE INVENTION

The present invention provides a heater unit for heating water which is supplied to a steam-generating boiler of an electric energy production installation which includes an alternator driven by a turbine having at least one low-pressure body connected by a housing to a steam condenser situated under said low-pressure body, said heater unit comprising a nest of tubes located inside said housing and being supplied with water coming from an extraction circuit for the condenser and the outer surface of the tubes being supplied with steam drawn off from the low-pressure body, the nest of tubes being substantially horizontal and perpendicular to the axis of the turbine, the cross-section of the nest of tubes of said heater unit being narrow and elongate and the length of said cross-section being disposed substantially vertically, the nest of tubes being enclosed in a casing which both channels the steam around the nest of tubes and receives the steam bleed-off pipes, wherein the cross-section of said casing has, in the region of the bleed-off steam supply pipes, one of its sides which, going up from the bottom, slopes progressively away going from the corresponding one of the two substantially vertical sides of said narrow elongate cross-section of said nest of tubes and, beyond said region, a cross-section which, while leaving a space for steam to pass, follows the profile of the contour of the cross-section of the nest of tubes, steam being supplied above said casing.

Preferably, steam is supplied via the upper portion of the casing and flows between said side of the casing and the corresponding side of the narrow elongate cross-section of the nest of tubes.

The invention also provides a water heater including two separate heater units for heating water, wherein said units are located at the same level and are supplied with bled-off steam whose thermodynamic level is the same in both units which are supplied by pipes coming from a low-pressure body with a central inlet and two symmetrical outlets.

According to a preferred embodiment of the invention, said two separate heater units for heating water with bled-off steam are supplied at one thermodynamic level and wherein a second heater located on the outside of said housing is supplied with bled-off steam at a second thermodynamic level via pipes which pass between said two units.

Preferably, the bleed pipes connect said low-pressure body to the upper surface of said casing in a substantially rectilinear manner.

Preferably, the cross-section of the assembly formed by the casing and the nest of tubes may be slightly inclined relative to the vertical so as to facilitate the flow of the condensates on the further side to that on which steam is supplied.

BRIEF DESCRIPTION OF THE DRAWINGS

The invention will better understood from the description of an embodiment thereof described hereinafter with reference to the accompanying drawings in which.

MORE DETAILED DESCRIPTION

Figure 1:
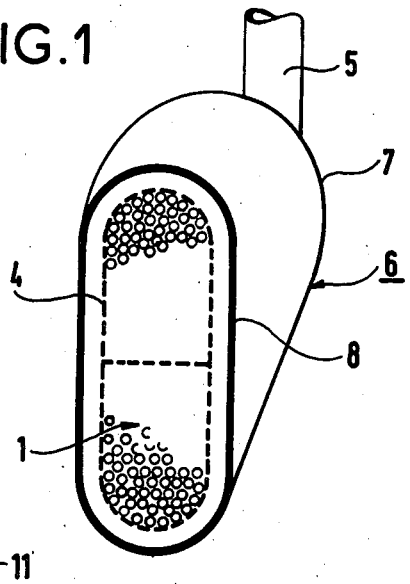
FIG. 1 is a schematical cross-section through a water heater unit in accordance with the invention.
Figure 3:
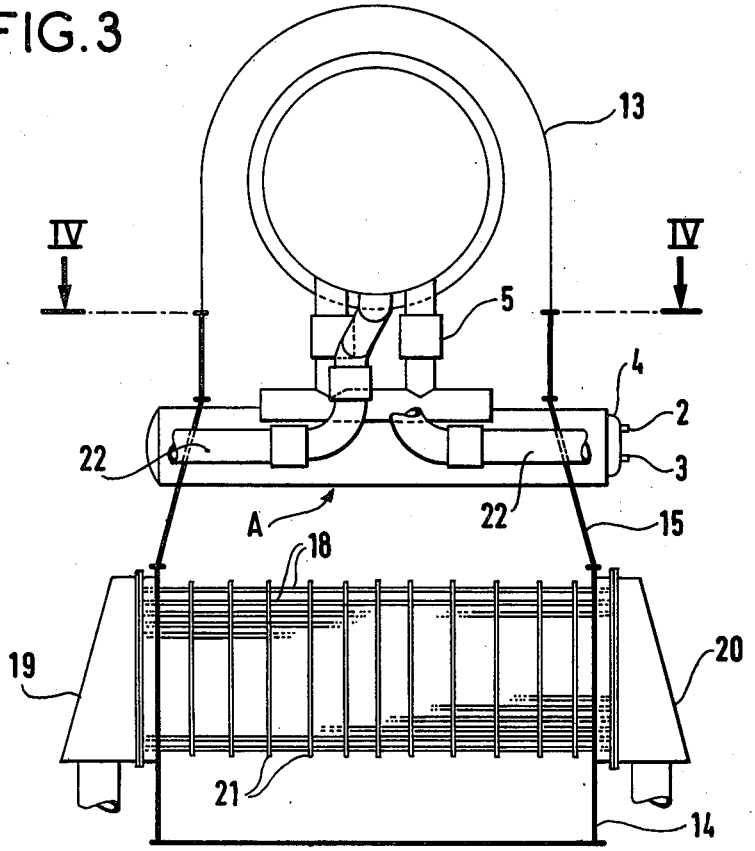
FIG. 3 is a side elevation of the unit in FIG. 1.

In FIG. 1, a water-heating unit in accordance with the invention includes a nest 1 of tubes which, in the assembly described, are bent into a U shape and which, as illustrated in FIG. 3 therefore have inlets 2 and outlets 3 on the same side with a water manifold 4 in between the inlets and the outlets. The cross-section of the nest 1 of tubes is narrow and elongate. It is substantially rectangular, the longer side of the section being placed vertically. Water is supplied to the tubes by the extraction circuit of the condenser and bled-off steam is supplied to the outside walls of the tubes by bleed-off pipes such as 5. The nest 1 of tubes is enclosed in a casing 6 which channels the steam around the nest of tubes. The cross-section of said casing 6 is not the same along the entire length to be heated. At the joint between the bleed-off pipes 5 and the casing 6, the cross-section of said casing is such as shown in FIG. 1 at reference 7, i.e. such that one side of said casing, namely, the right-hand side in the figure, slopes away from the other starting at the bottom and getting further away from the corresponding side of the cross-section of the nest of tubes as it goes up. Beyond the region in which the bleed-off pipes 5 are joined to the casing 6, the cross-section of said casing has the same shape as the cross-section but on a slightly larger scale. Steam is let in via the bleed-off pipes 5 from above the portion 7 of the casing 6 between the sloping wall of said portion 7 and the nest 1 of tubes.

Figure 2:
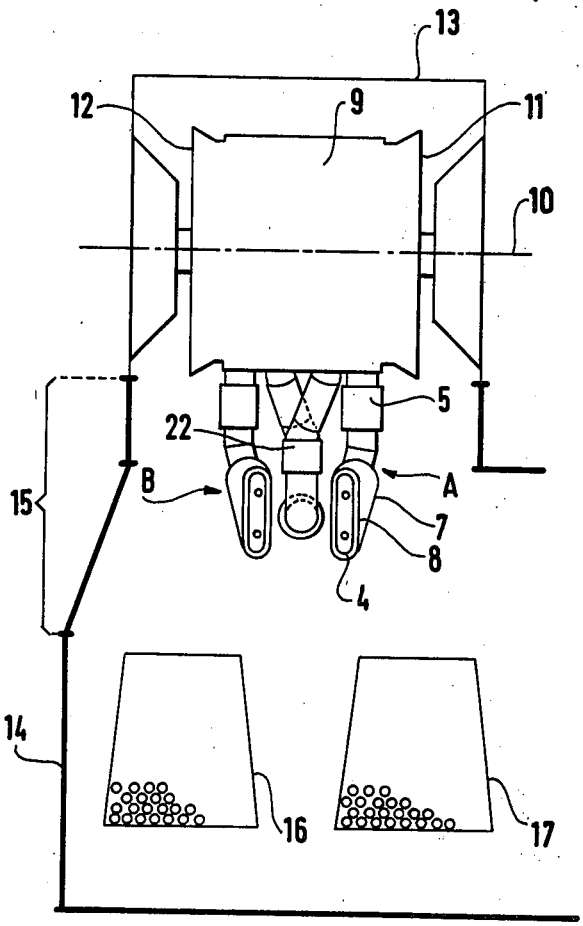
FIG. 2 is a general illustration showing the location of a water heater in accordance with the invention relative to the turbine and/or to the condenser.
Figure 4:
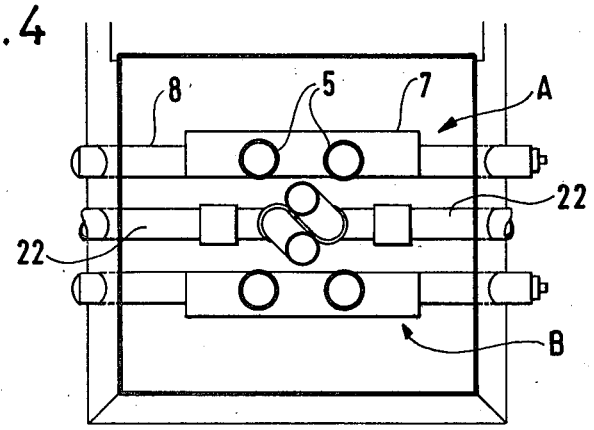
FIG. 4 is a cross-section along IV—IV of FIG. 3.

FIGS. 2, 3 and 4 illustrate a low-pressure turbine 9 with an axis 10, said turbine having two symmetrical outlets 11 and 12 located in an exhaust box 13 which is connected to a condenser body 14 by a housing 15. Two nests of tubes are placed inside the condenser body 14, the cross-sections of these nests being referenced 16 and 17. Manifolds 19 and 20 supply the pipes 18 with water from the cold source. Spacer plates 21 support the tubes.

A water-heater whose bleed-off level is S1 and which has two units A and B similar to the unit in FIG. 1 is placed inside the housing 15. Bleed-off pipes 5 supply these units A and B from points where the thermodynamic level is the same as above, i.e. S1. Two pipes 5 supply each unit A or B as illustrated in FIG. 4. These units are disposed perpendicularly to the axis 10 of the turbine.

The figures also show bleed-off pipes 22 used at a second thermodynamic level S2. However, these pipes 22 communicate with a heater, not illustrated, placed outside the housing 15.

The advantage of the structure and of the disposition of the heater in accordance with the invention are clearly understandable from these figures; indeed, it is observed that the assembly is particularly compact, the tubing remaining under the turbine in a zone which does not hinder the exhaust steam from passing; the bleed-off pipes follow a particularly simple path and thereby reduce head losses.

The very fact that the nest of tubes is narrow and elongate leaves a wide space for the exhaust steam to pass. This is all the more so as the casing 6 is flared only along a portion 7 of the length of the nest. Also, the inside of the heater is very well supplied with bleed-off steam without there being any need to extend said flared portion 7 along the entire length.

I claim:

1. A heater unit for heating water which is supplied to a steam-generating boiler of an electric energy production installation, said installation including an alternator driven by a turbine having at least one low-pressure body connected by a housing to a steam condenser situated under said low-pressure body, said heater unit comprising a nest of tubes located inside said housing and being supplied with water coming from an extraction circuit for the condenser and the outer surface of the tubes being supplied with steam drawn off from the low-pressure body, the nest of tubes being substantially horizontal and perpendicular to the axis of the turbine, the cross-section of said nest of tubes of said heater unit being narrow and elongate with the elongate being disposed substantially vertically, the nest of tubes being enclosed in a casing which both channels the steam around the nest of tubes and receives the steam bleed-off pipes, and wherein the cross-section of said casing has, in the connection region of the bleed-off steam supply pipes, one of its sides which, going up from the bottom slopes progressively away, going from the corresponding one of the two substantially vertical sides of said narrow elongate cross-section of said nest of tubes and, beyond said region, a cross-section which, while leaving a space for steam to pass, follows the profile of the contour of the cross-section of the nest of tubes, and means for supplying steam from above said casing via said pipes.

2. A heater unit according to claim 1 for heating water, wherein steam is supplied to the upper portion of the casing and flows between said side of the casing and the corresponding side of the narrow elongate cross-section of the nest of tubes.

3. A water heater including two heater units according to claim 2 for heating water, wherein said units are located at the same level and are supplied with bleed-off steam whose thermodynamic level is the same in both units supplied by pipes coming from a low-pressure body with a central inlet and two symmetrical outlets.

4. A water heater according to claim 3, wherein said two separate heater units for heating water with bled-off steam are supplied at one thermodynamic level and wherein a second heater located on the outside of said housing is supplied with bled-off steam at a second thermodynamic level via pipes which pass between said two units.

5. A heater according to either one of claims 3 or 4, wherein the bleed pipes connect said low-pressure body to the upper surface of said casing in a substantially rectilinear manner.

6. A heater accroding to claim 1 wherein the cross-section of the assembly formed by the casing and the nest of tubes is slightly inclined relative to the vertical so as to facilitate the flow of the condensates on the further side to that side on which steam is supplied.

* * * * *